US007987924B2

(12) United States Patent
Mitchell et al.

(10) Patent No.: US 7,987,924 B2
(45) **Date of Patent: *Aug. 2, 2011**

(54) AUTOMATIC CONTROL SYSTEM FOR CONNECTING A DUAL-MEMBER PIPE

(75) Inventors: Bradley E. Mitchell, Perry, OK (US); Geoff D. Koch, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/632,326

(22) Filed: Dec. 7, 2009

(65) Prior Publication Data

US 2010/0307824 A1 Dec. 9, 2010

Related U.S. Application Data

(63) Continuation of application No. 11/828,963, filed on Jul. 26, 2007, now Pat. No. 7,628,226.

(60) Provisional application No. 60/820,371, filed on Jul. 26, 2006.

(51) Int. Cl.
*E21B 44/00* (2006.01)

(52) U.S. Cl. ..... 175/27; 175/24; 166/380

(58) Field of Classification Search ..... 175/24, 175/40, 122, 162; 166/77.51, 250.01, 379, 166/380; 173/34, 35; 299/75, 11
See application file for complete search history.

(56) References Cited

U.S. PATENT DOCUMENTS

| | | | | |
|---|---|---|---|---|
| 2,338,625 | A | 1/1944 | Curtis | |
| 3,692,123 | A | 9/1972 | Gyongyosi | |
| 3,768,579 | A | 10/1973 | Klein | |
| 4,042,123 | A | 8/1977 | Sheldon et al. | |
| 4,453,603 | A | 6/1984 | Voss et al. | |
| 5,168,890 | A | 12/1992 | Bongart et al. | |
| 5,321,506 | A | 6/1994 | Sargent | |
| 5,355,965 | A | 10/1994 | Rozendaal | |
| 5,661,888 | A | 9/1997 | Hanslik | |
| 6,179,065 | B1 | 1/2001 | Payne et al. | |
| 6,550,547 | B1 | 4/2003 | Payne et al. | |
| RE38,418 | E * | 2/2004 | Deken et al. | 175/19 |
| 6,845,825 | B2 | 1/2005 | Bischel et al. | |
| 7,011,166 | B2 * | 3/2006 | Koch et al. | 175/24 |
| 7,216,724 | B2 | 5/2007 | Self et al. | |
| 7,628,226 | B2 * | 12/2009 | Mitchell et al. | 175/27 |
| 2008/0073123 | A1 * | 3/2008 | Mullins et al. | 175/62 |

FOREIGN PATENT DOCUMENTS

WO 02/079603 A1 10/2002

* cited by examiner

*Primary Examiner* — Kenneth Thompson
*Assistant Examiner* — James G Sayre
(74) *Attorney, Agent, or Firm* — Tomlinson Rust McKinstry Grable

(57) ABSTRACT

A system and method of making up and breaking out a dual-member drill string. The system comprises a spindle, a spindle carriage and a drive frame. The drive frame provides thrust to the spindle, while the spindle carriage provides rotation. The spindle has an outer spindle and an inner spindle, and is adapted to connect to a pipe section having an outer pipe section and an inner pipe section. Inner joints are geometrically shaped, while outer joints are threaded. When making up dual member drill string, the spindle is advanced, with the outer spindle rotating, and the inner spindle rotating in alternating directions, or "dithering." A float sensor and a processor are used in tandem to cooperatively couple the inner spindle with the inner pipe sections and the outer spindle with the outer pipe sections.

33 Claims, 6 Drawing Sheets

AUTOMATIC CONTROL SYSTEM FOR CONNECTING A DUAL-MEMBER PIPE

CROSS REFERENCE TO RELATED APPLICATION

This application is a continuation of U.S. Ser. No. 11/828,963 filed on Jul. 26, 2007, which claims the benefit of provisional patent application Ser. No. 60/820,371 filed on Jul. 26, 2006, the entire contents of which are incorporated herein by reference.

FIELD OF THE INVENTION

The present invention relates to the field of horizontal boring machines, and more particularly to a makeup/breakout system for dual-member pipes.

SUMMARY OF THE INVENTION

In one embodiment the present invention is directed to a method for coupling a carriage to a dual-pipe drill pipe section. The method comprises the steps of advancing the carriage having an inner spindle and an outer spindle, automatically rotating the inner spindle clockwise and counterclockwise in an alternating fashion, and detecting a carriage float position. The inner spindle and the outer spindle of the carriage are connectable to a pipe section having an inner pipe section and an outer pipe section. The detected carriage float position indicates the inner spindle has not coupled with the inner pipe section.

Another embodiment of the present invention is directed to a method for adding a pipe section to a drill string. The pipe section comprises an inner pipe section and an outer pipe section. The drill string comprises an inner pipe and an outer pipe. The method comprises the steps of attaching a pipe section to a carriage, aligning an end of the inner pipe section with an end of the inner pipe, advancing the pipe section such that the inner pipe section is coupled to the inner pipe, monitoring a carriage float position, detecting a carriage float position, and coordinating rotation and thrust of the outer pipe section. The carriage is adapted to advance and rotate the pipe section, and characterized by an amount of float. The inner pipe and inner pipe section's ends are aligned such that the inner pipe section may be coupled to the inner pipe. The detected carriage float position is indicative of the inner pipe section not being coupled to the inner pipe. Thrust and rotation of the outer pipe section are coordinated such that the outer pipe section and the outer pipe are threaded together.

Yet another embodiment of the present invention is directed to a drill string make-up system. The system comprises a spindle, a carriage, a float sensor, and a processor. The spindle comprises an inner spindle and an outer spindle. The carriage is adapted to provide thrust and rotation to the spindles. The inner spindle is rotatable independent of the rotation of the outer spindle. The float sensor is adapted to determine the amount of float in the carriage and to transmit a float signal. The processor is adapted to receive the float signal and to control the rotation of the inner spindle in alternating clockwise and counterclockwise directions in response to the float signal.

DETAILED DESCRIPTION OF THE DRAWINGS

The present invention is directed to an automatic dual-pipe makeup/breakout system and a method for using the same. The system is provided for connecting or disconnecting an existing dual-pipe drill string to an additional dual-pipe section. Dual member pipes are useful in conjunction with horizontal boring machines particularly in rocky conditions. With a dual member pipe, an outer pipe is used for steering the drill string, while an independently rotatable inner member is used to provide cutting force for a drill bit. A preferred embodiment for a dual-member drill string system is disclosed in U. S. Reissue Pat. No. RE38,418, the contents of which are incorporated herein by reference. A system and method for the automatic connection of a one-pipe drill string to a one-pipe spindle is given in U.S. Pat. No. 7,011,166, the contents of which are also incorporated herein by reference.

Figure 1:
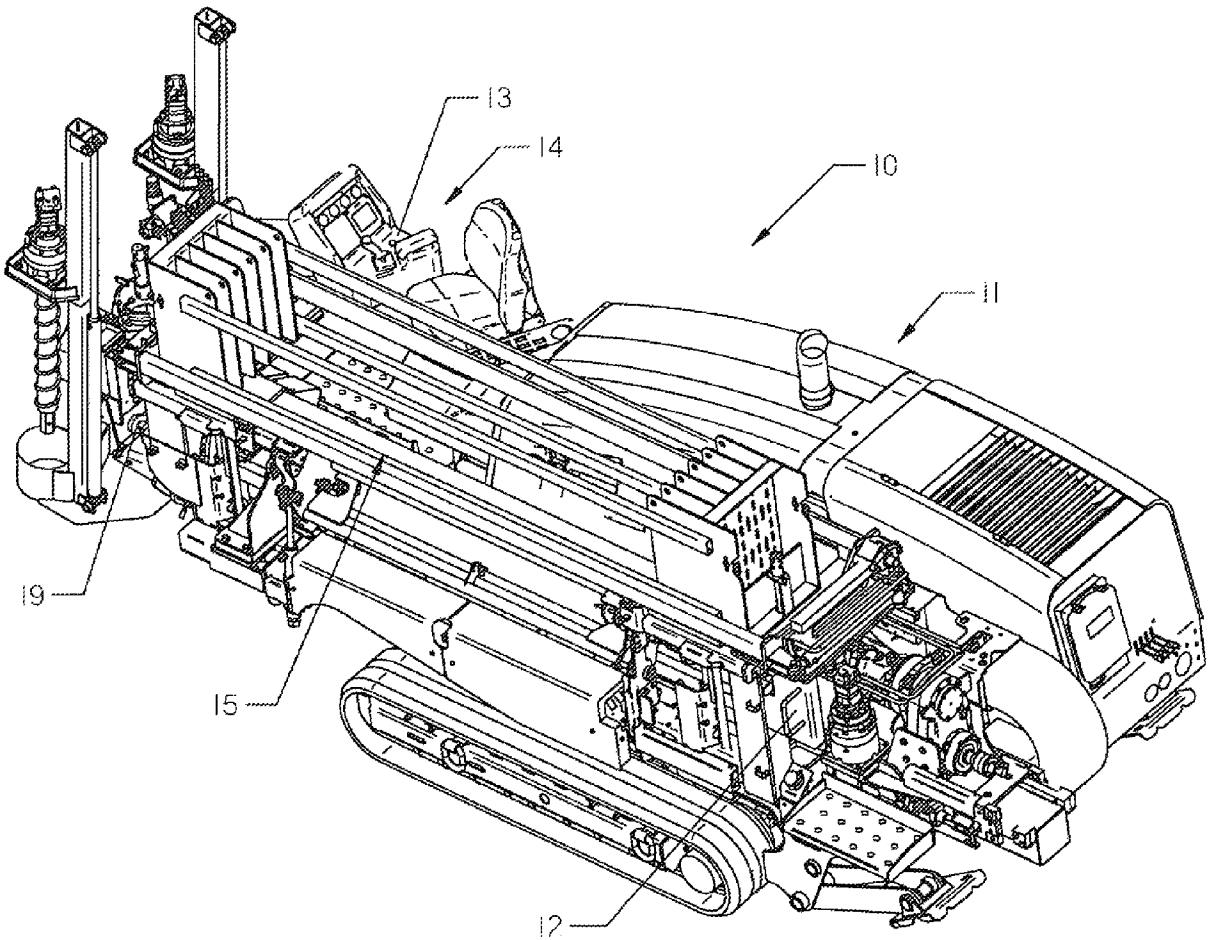
FIG. 1 is a view of a boring machine comprising the makeup/breakout system of the present invention.

Turning to the drawings in general and FIG. 1 in particular, there is shown in FIG. 1 a makeup/breakout system, designated by reference number 10 in accordance with the present invention for use with a horizontal boring machine 11. The makeup/breakout system 10 is generally secured to a drill frame 12 of a boring machine. The makeup/breakout system 10 is operated and monitored with controls located at an operator's console 13. The operator's console 13 contains a control panel having a display, joystick, and other machine function control mechanisms, such as switches and buttons. From the control panel, each of the underlying functions of the boring machine 11 can be controlled. The display on the control panel may include a digital screen and a plurality of signaling devices, such as gauges, lights, and audible devices, to communicate the status of the operations to the operator. A processor 14 is adapted to respond to signals from various sensors of the system 10 and adjust functions of the system in response to the signals. The system 10 further comprises a pipe handling system 15 supported on the drill frame 12 for placement of sections of pipe for the operations described below.

Figure 2:
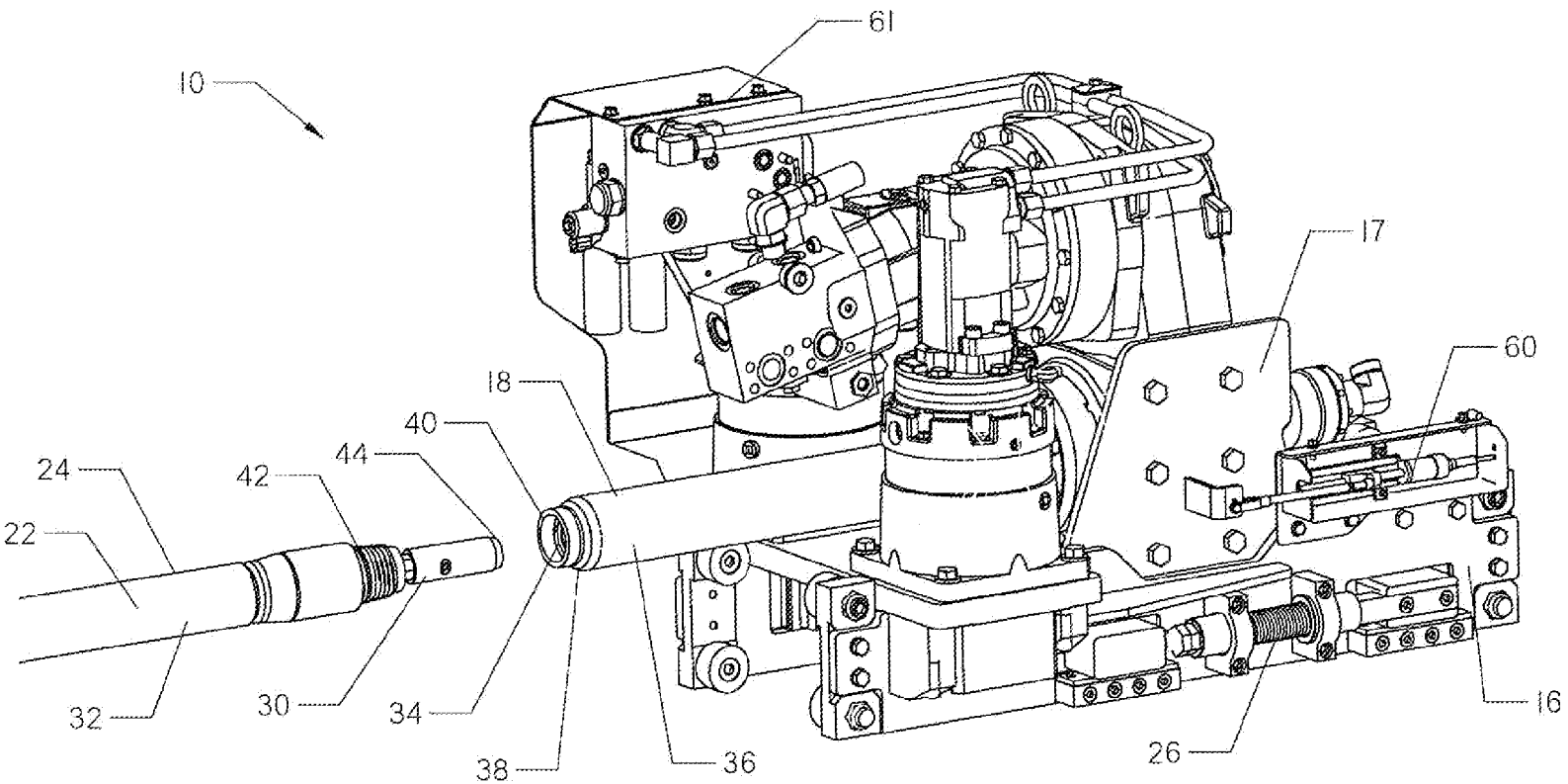
FIG. 2 is a cut-away view of a makeup/breakout system.

Turning now to FIG. 2, the system 10 generally comprises a drive frame 16, a spindle carriage 17 supported on the drive frame and a spindle 18. The system 10 comprises a front clamp wrench 19, shown in FIG. 1, and pipe loader grippers (not shown). The front clamp wrench 19 is located at a front end of the drill frame 12 and adapted to prevent rotation or translation of a dual member drill string 22. The pipe loader grippers are located on the pipe handling system 15 and adapted to prevent rotation or translation of a pipe section 24.

With reference again to FIG. 2, the drive frame 16 is adapted to provide power to the spindle carriage 17. The spindle carriage 17 is supported on the drive frame 16 and adapted to support and provide rotation and thrust to the spindle 18. As used herein, thrust is intended to mean the advancement or retraction of the carriage 17. Preferably, the spindle carriage 17 is connected to the drive frame 16 by a spring-centering device 26. The spring-centering device 26 biases the spindle carriage 17 to a default position relative to the drive frame 16.

As depicted in FIG. 2, the system 10 is connected to the dual-member drill string 22 by way of the spindle 18. The dual-member drill string 22 is made up of a plurality of pipe sections 24. Each pipe section 24 comprises an inner pipe section 30 and an outer pipe section 32. Preferably, each outer pipe section 32 has threaded male and female ends for threaded connecting to other pipe sections. Preferably, each inner pipe section 30 has geometrically formed male and female ends for torque transmitting slip fit connection to other inner pipe sections. As those skilled in the art will appreciate, alternatives to the threaded connections of the outer pipe sections 32 and the geometrical connections of the inner pipe sections 30 are contemplated.

The spindle 18 comprises an inner spindle 34 and an outer spindle 36. The outer spindle 36 preferably comprises a threaded spindle pipe joint 38. The inner spindle 34 preferably comprises a geometrical spindle pipe joint 40. The threaded spindle pipe joint 38 is adapted for connection to a threaded pipe joint 42 on a first end of the outer pipe section 32. The geometrical spindle pipe joint 40 is adapted for connection to a geometrical pipe joint 44 on a first end of an inner pipe section 30. Preferably, the geometrical pipe joints 40, 44 comprise hex joints. As used herein, a pipe joint can be either of the male or female ends of a pipe section 24.

The processor 14 is adapted to receive signals from a float sensor 60 and a rotation pressure sensor 61. The processor 14 receives and interprets the signals, and automatically adjusts thrust and rotation of the spindle 18 as will be discussed further below.

Figure 3:
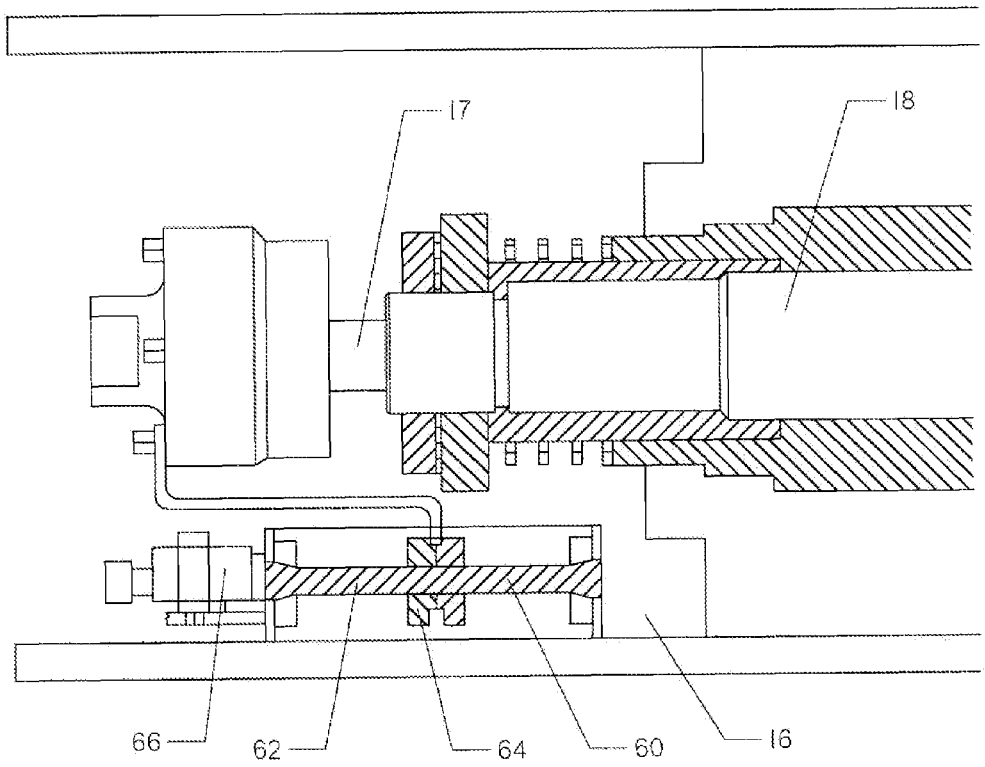
FIG. 3 is a side view of a spindle carriage.

The float sensor 60 is used to measure the relative amount of float between the spindle carriage 17 and the drive frame 16. Preferably, the float sensor 60 is an electromagnetic absolute position sensor, though other devices could also be used, such as linear variable displacement transducers, photoelectric devices, resistive potentiometers, and ultrasonic sensors. In the embodiment illustrated in FIG. 3, the float sensor 60 comprises a sensor rod 62, a magnet 64, and associated electronics 66. The sensor rod 62 is secured to the drive frame 16. The magnet 64 is coupled to the spindle carriage 17. The magnet 64 is positioned to move along the sensor rod 62 as the carriage 17 floats relative to the drive frame 16. The associated electronics 66 are adapted to determine the position of the magnet 64 along a length of the sensor rod 62 and transmit a float signal indicative of the amount of relative float. Position sensors such as this are common in the art and many alternative sensors may be contemplated for use with the present invention.

Figure 4:
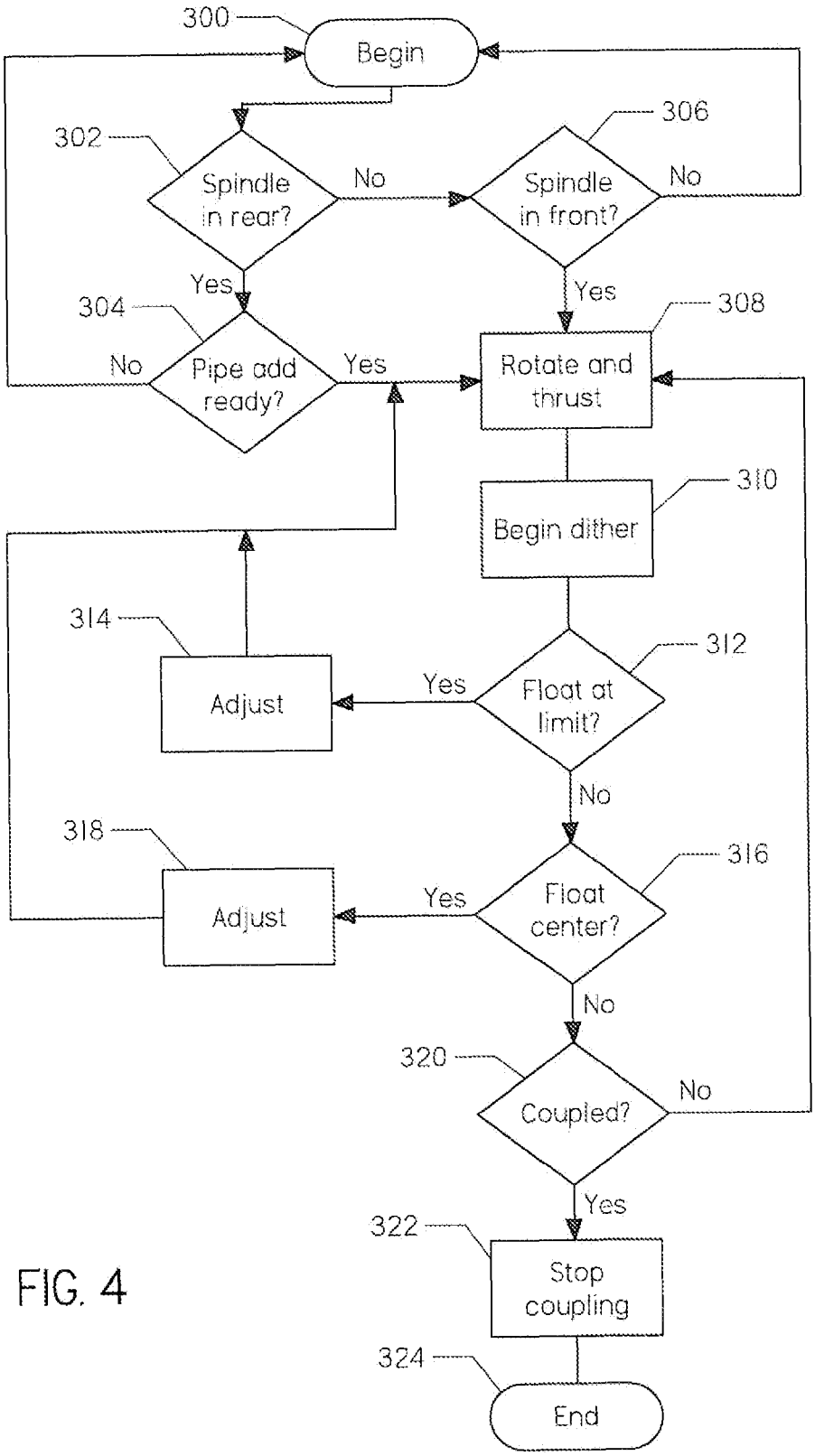
FIG. 4 is a flowchart depicting a method of connecting a spindle to a pipe section.

With reference generally to FIG. 4, shown therein is a preferred procedure for connecting the spindle 18 to a pipe section 24. The routine begins at 300 and is equally applicable to the system 10 in a drilling or a backreaming mode. At 302, a check is made to see if the spindle 18 is in a rear of the drill frame 12, the front clamp wrench 19 is closed, and the drilling machine is operating in the drilling mode. If the machine is operating in the drilling mode, acting in parallel, the processor 14 will have begun a routine to activate the pipe handling assembly 20 to load a pipe section 24. At 304, a check is made to see if the pipe section 24 is in position for adding. If so, connection of the spindle 18 to a pipe section 24 may begin. If the answer was no at 302, the routine checks at 306 to see if the spindle 18 is at a front of the drill frame 12, the front clamp wrench 19 is closed, and if the drilling machine is in the backreaming mode. If so, connection of the spindle 16 to the drill string 22 may begin.

At 308, the rotation and thrust of the spindle 18 is begun as a connection routine is started. The connection routine is described below in FIG. 6. It will be appreciated that thrust of the carriage 17 and rotation of the spindle 18 should be coordinated by the processor 14. If the carriage 17 is applying too much thrust or too little thrust, the carriage 17 will displace from the default position relative to the drive frame 16. The float sensor 60 signals this displacement, and the processor 14 automatically adjusts the thrust and/or rotation so the float sensor 60 will move back to the default position. If the float sensor 60 reaches a limit, or is significantly displaced while rotation is not occurring (thus keeping the spindle 18 from coupling with a pipe section 24), a limit signal is sent to the processor 14 and thrust and/or rotation are automatically stopped.

In the drilling mode, the pipe handling system 15 will place a pipe section 24 comprising an inner pipe section 30 and an outer pipe section 32 into a position proximate the spindle 18. The pipe holders of the pipe handling system 15 grip and hold the pipe section 24 in place. One of skill in the art will appreciate the pipe handling system 15 can position the pipe section 24 and prevent some rotation of the pipe section as the spindle 18 is connected.

While the carriage 17 is advanced and the outer spindle 36 rotates, the dithering of the inner spindle 34 is begun at 310. The dithering process is more fully described below in regards to FIG. 5. "Dithering" comprises the alternate rotating of the inner spindle 34 in a clockwise and counterclockwise fashion.

Dithering is needed because the geometrical spindle pipe joint 40 of the inner spindle 34 may contact the geometrical pipe joint 44 of the inner pipe section 30 if the joints are not geometrically aligned to permit coupling of the joints. This contact displaces the spindle carriage 17 from the drive frame 16 as the carriage advances, causing the float sensor 60 to become displaced from the default position. When an orientation of the geometrical pipe joint 44 of the inner pipe section 30 matches an orientation of the geometrical pipe joint 40 of the inner spindle 34, the inner spindle and the inner pipe section will couple.

When dithering, the clockwise and counterclockwise rotation amount of the inner spindle is kept approximately the same using a sensor which provides inner spindle 34 rotation travel information. Preferably, the inner spindle 34 is rotated through a 180 degree arc to achieve coupling. After each rotation, the travel of the spindle is read and compared to a target travel. If the actual inner spindle 34 travel is not equal to the desired travel, a correction can be made to the inner spindle on a next movement. If the float sensor 60 detects that the float position reaches a limit at 312, a speed or an orientation of the inner spindle 34 may be alternatively adjusted, an inner spindle rotation direction changed, and dither restarted at 314. Preferably, the angle of inner spindle 34 rotations may be adjusted to geometrically align the joints. Alternatively, an operator may override the automated process and match the orientation of the inner spindle 34 to the orientation of the inner pipe section 30. When the inner spindle 34 begins to couple with the inner pipe section 30, the spring centering device 26 will force the spindle carriage 17 to a default float position.

In the preferred embodiment, the outer spindle 36 does not contact the outer pipe section 32 until the inner spindle 34 couples with the inner pipe section 30. When the inner spindle 34 aligns with the inner pipe section 30, the spring centering device 26 pushes the spindle carriage 17 back to a default float position, which further couples the inner spindle to the inner pipe section. Preferably, the threaded joint 42 of the outer pipe section 32 will begin to couple with the threaded pipe joint 38 of the outer spindle 36 as the inner spindle 34 is coupled. One skilled in the art will appreciate that improper coupling of a threaded joint on a pipe section may cause the locking or stripping of the threads.

In order to avoid stress on the threads, rotation and thrust of the spindle 18 is coordinated by the float sensor 60 and the processor 14 to ensure proper coupling. If the spindle 18 is rotating it is assumed by the processor 14 that the spindle is being threaded to or from the pipe section 24. The processor 14 synchronizes the thrust speed with the rotation to keep the float in its default position. If the drive frame 16 gets too far ahead of the spindle 18 mechanism, the float position will be off center at 316, and thrust is stopped at 318 until rotation catches up and the spindle carriage 17 moves back toward the center position. Likewise, if the spindle carriage 17 gets too far ahead of the drive frame 16 at 316, rotation will be slowed or stopped at 318 until thrust catches up with the drive frame and re-centers float.

The system further comprises the rotation pressure sensor 61 as an additional way of checking whether connections are properly made up. When the outer spindle 36 is coupling with the outer pipe section 32, the sensor will detect substantially constant rotation pressure. When the coupling is complete, the rotation of the outer spindle 36 continues, and the rotation pressure may spike. The processor 14 detects the rise in the rotation pressure sensor signal and determines that the coupling is complete. The processor 14 then may stop the rotation of the spindle carriage 17. Preferably, the pipe joints are adapted such that when threads on the outer pipe section 32 are fully made up the sliding geometrical pipe joints 40, 44 are fully seated.

If in drilling mode, the rotation pressure sensor will not sense completed connection until the pipe section 24 is connected to the drill string 22. Rotation and thrust of the spindle 16 are continued as the pipe section 24 is advanced towards the drill string 22. To connect the pipe section 24 to the drill string 22, the front clamp wrench 19 is closed about the drill string. The first pipe section 24, coupled to the spindle 18, is then advanced, and the inner pipe section 30 is dithered. Preferably, the inner pipe section 30 must be coupled to the inner pipe section of the drill string 22 before the outer pipe section 32 contacts the outer pipe section of the drill string. The float sensor 60 and the rotation pressure sensor detect at 320 when coupling of the pipe section 24 and the drill string 22 is complete and rotation and thrust are stopped at 322.

Upon coupling the pipe section 24 to the drill string 22, the front clamp wrench 19 opens and the pipe grippers of the pipe handling system 15 are retracted to allow drilling operations to resume at 324. Rotation and thrust of the spindle 18 cause the drill string 22 to advance, until such time as the spindle carriage 17 reaches a front end of the drill frame 12 and the process of adding another pipe section 24 is repeated.

Figure 5:
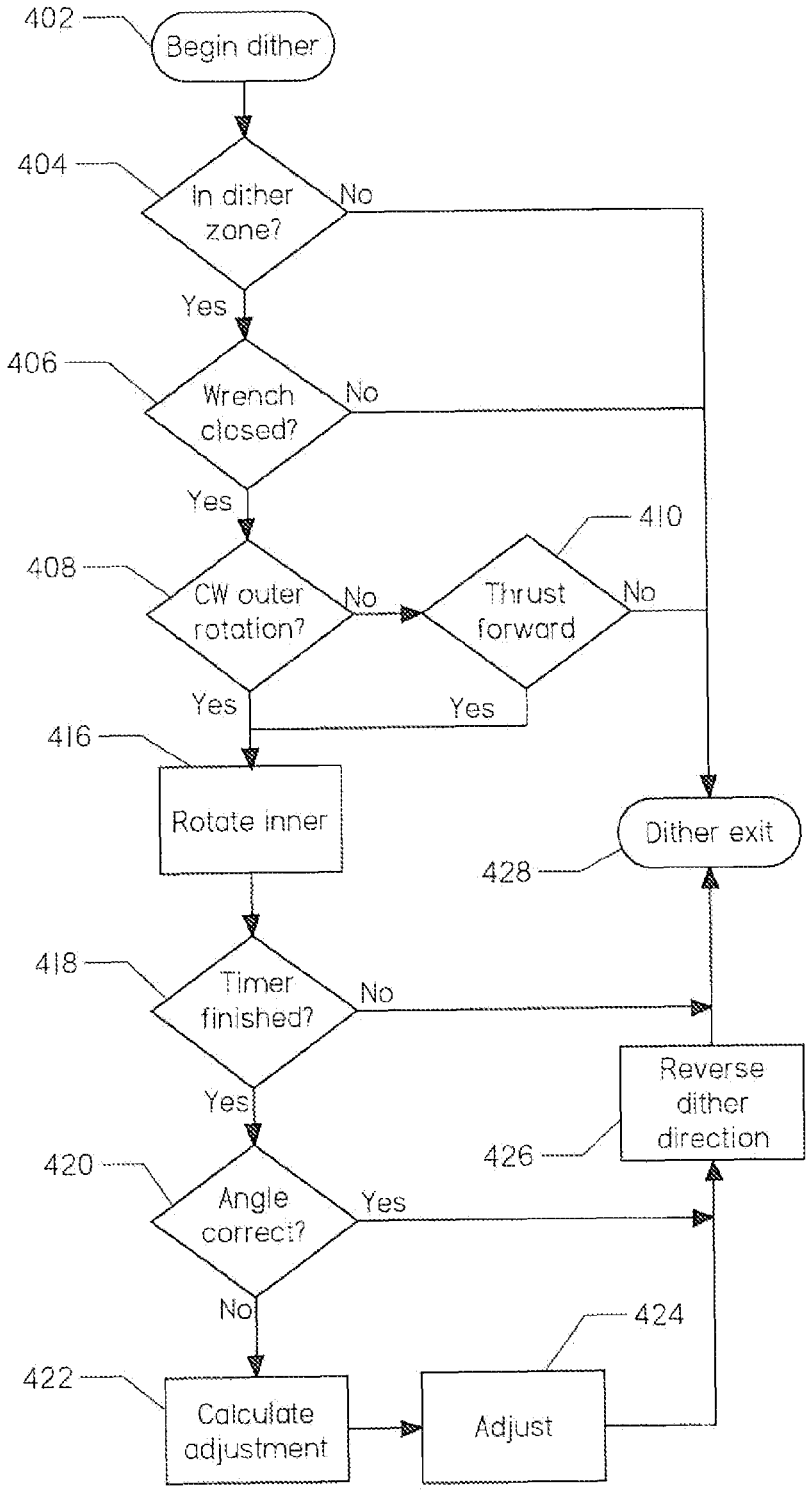
FIG. 5 is a flowchart depicting a method of coupling an inner spindle.

The flow chart of FIG. 5 depicts an example of logic used by the processor 14 during the dithering of the inner spindle 34. The routine waits at 402 for a signal that the spindle 18 is in a dither zone 404. The dither zone is defined as the position of the spindle carriage 17 either at the rear of the drill frame 12 when the spindle 18 is to be connected to a pipe section 24 or at the front of the drill frame when the spindle is to be connected to the drill string. If the spindle 18 is in the dither zone at 404, the routine asks if the wrench is closed at 406. At 408, the routine asks if outer spindle 36 rotation is clockwise. If not, a check is made at 410 to see if thrust is forward. If thrust is forward at 410, or if outer spindle 36 rotation is clockwise at 408, then the inner spindle 34 is rotated at 416.

The routine waits for a given time to allow the rotation of the inner spindle 34 to expire at 418. When the time is expired at 418, the processor 14 checks the dither angle at 420. An incorrect dither adjustment will require the processor 14 to calculate the dither adjustment at 422 and adjust the dither speed at 424. Finally, the direction of rotation of the inner spindle 34 is reversed at 426. The makeup/breakout process can proceed at 428.

Figure 6:
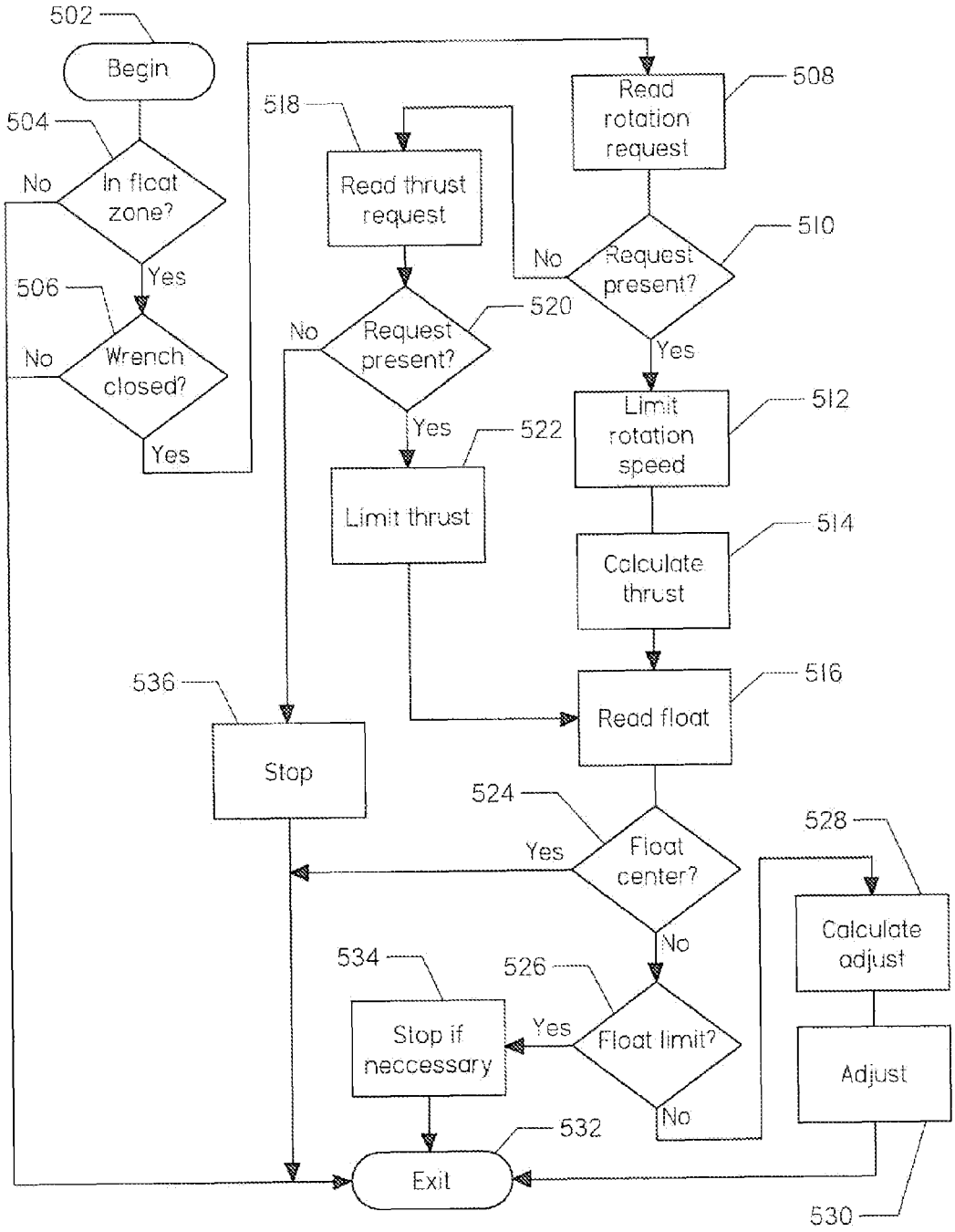
FIG. 6 is a flowchart depicting a method of coupling an outer spindle.

A logic sequence for the processor 14 to follow for coordinating thrust and rotation of a threaded outer spindle 36 and outer pipe section 32 during pipe makeup/breakout is shown in FIG. 6. The processor 14 begins at 502. The processor 14 checks that the spindle 18 is in a float zone at 504 and that the front clamp wrench 19 is closed at 506. With these conditions met, a request for rotation is read at 508. If a request for rotation is present at 510, the rotation speed of the outer spindle 36 is limited at 512, an output for thrust based on rotation is calculated at 514 by the processor 14, and a float position is read at 516. If a request for rotation is not present at 510, a request for thrust is read at 518. If a request for thrust is present at 520, thrust speed is limited at 522 and the float position is read at 516. If float is not centered at 524, and float is not at a limit at 526, thrust adjustment is calculated at 528, thrust speed is adjusted at 530, and the makeup/breakout process may continue at 532. If the float is at a limit at 526, thrust or rotation is stopped as needed at 534, and the makeup/breakout process continues at 532. If no thrust request is present at 520, thrust and rotation of the outer spindle 36, if any, is stopped at 536 and the makeup/breakout process may continue at 532.

Various modifications can be made in the design and operation of the present invention without departing from its spirit. For example, the inner pipe may be threaded or connect in a snap-together or lock together manner. Other configurations of the outer pipe are also applicable. Measurements other than float, such as contact, proximity, pressure, force or torque can be utilized for controlled coordination of the dual-pipe drill string. Thus, while the principal preferred construction and modes of operation of the invention have been explained in what is now considered to represent its best embodiments, it should be understood that within the scope of the appended claims, the invention may be practiced otherwise than as specifically illustrated and described.

The invention claimed is:

1. A drill string make-up system comprising:

a drive frame;

a spindle comprising an inner spindle and an outer spindle connectable to a pipe section having an inner pipe section and an outer pipe section;

a carriage supported on the drive frame to provide thrust and rotation to both the inner spindle and outer spindle, wherein the inner spindle is rotatable independent of rotation of the outer spindle;

a float sensor to determine the amount of float between the carriage and the drive frame and to transmit a float signal indicating that the inner spindle has not coupled with the inner pipe section of the drill string; and a processor to receive the float signal and to automatically control rotation of the inner spindle 180 degrees in alternating clockwise and counterclockwise directions in response to the float signal.

2. The system of claim 1 further comprising a pipe handling system disposed proximate the carriage to load a pipe section into the carriage.

3. The system of claim 2 wherein the pipe handling system comprises a clamp wrench to prevent rotation and translation of the drill string and a plurality of pipe loader grippers to prevent rotation and translation of the pipe section supported within the carriage for connection to the drill string.

4. The system of claim 1 wherein the float sensor comprises centering springs.

5. The system of claim 1 wherein the processor further controls rotation of the outer spindle in response to the float signal.

6. A horizontal boring machine comprising a makeup/breakout system, the makeup/breakout system comprising:

a drive frame;

a spindle comprising an inner spindle and an outer spindle connectable to a pipe section having an inner pipe section and an outer pipe section;

a carriage supported on the drive frame to provide thrust and rotation to both the inner spindle and the outer spindle, wherein the inner spindle is rotatable independent of rotation of the outer spindle;

a float sensor to determine the amount of float between the carriage and the drive frame and to transmit a float signal indicating the inner spindle has not coupled with the inner pipe section; and a processor to receive the float signal and to automatically dither rotation of the inner spindle in alternating clockwise and counterclockwise directions and control thrust and rotation of the outer spindle in response to the float signal.

7. The system of claim 6 wherein the float sensor comprises centering springs.

8. The system of claim 6 wherein the carriage thrusts and rotates the outer spindle and inner spindle to couple a pipe section to the drill string.

9. The system of claim 6 wherein the inner spindle comprises a geometrical spindle pipe joint and the outer spindle comprises a threaded spindle pipe joint.

10. The system of claim 9 wherein the geometrical spindle pipe joint comprises a hex joint.

11. The system of claim 6 wherein the float sensor comprises an electromagnetic position sensor.

12. The system of claim 6 wherein the float sensor comprises:

a sensor rod secured to the drive frame;

a magnet secured to the carriage and positioned to move along the sensor rod as the carriage floats relative to the drive frame; and a circuit to determine the position of the magnet along a length of the sensor rod and transmit the float signal to the processor.

13. The system of claim 6 comprising a clamp wrench to prevent rotation and translation of the drill string and a pipe loader gripper to prevent rotation and translation of the pipe section.

14. The system of claim 6 wherein the inner spindle comprises a threaded spindle pipe joint.

15. A system for creating a borehole, the system comprising:

a drilling machine;

a carriage supported on the drilling machine, the carriage comprising an inner spindle and an outer spindle;

a drill string comprising an inner member operatively connectable to the inner spindle and an outer member operatively connectable to the outer spindle;

a float sensor supported by the drilling machine to detect a carriage float position indicative of whether an inner member of a pipe section connected to the inner spindle is coupled to the inner member of the drill string, and to generate and transmit a float signal;

a processor to receive the float signal and to automatically command thrust of the carriage and dither rotation of the inner spindle in alternating clockwise and counterclockwise directions in response to the float signal to connect the inner member of the pipe section to the inner member of the drill string; and a downhole tool assembly supported on the drill string.

16. The system of claim 15 wherein the float sensor comprises centering springs.

17. The system of claim 15 wherein the carriage further thrusts and rotates the outer spindle to couple an outer member of the pipe section to the outer member of the drill string.

18. The system of claim 15 wherein the inner spindle comprises a geometrical spindle pipe joint and the outer spindle comprises a threaded spindle pipe joint.

19. The system of claim 18 wherein the geometrical spindle pipe joint comprises a hex joint.

20. The system of claim 15 wherein the float sensor comprises an electromagnetic position sensor.

21. The system of claim 15 wherein the float sensor comprises:

a sensor rod secured to the drive frame;

a magnet secured to the carriage and positioned to move along the sensor rod as the carriage floats relative to the drive frame; and a circuit to determine the position of the magnet along a length of the sensor rod and transmit the float signal to the processor.

22. The system of claim 15 further comprising a pipe handling system adapted to load the pipe section into the carriage.

23. The system of claim 15 wherein the processor is further adapted to control rotation of the outer spindle in response to the float signal.

24. The system of claim 22 wherein the pipe handling system comprises pipe loader grippers.

25. A system for adding a pipe section to a drill string, the pipe section comprising an inner pipe section and an outer pipe section, the drill string comprising an inner pipe and an outer pipe, the system comprising:

a carriage operatively connected to the pipe section to thrust and rotate the pipe section, the carriage comprising an inner spindle connectable to the inner pipe and an outer spindle connectable to the outer pipe;

a float sensor to detect a carriage float position indicative of whether the inner spindle is coupled to the inner pipe section, and to generate and transmit a float signal; and a processor to receive the float signal and to automatically command thrust of the carriage and dither rotation of the inner spindle in alternating clockwise and counterclockwise directions in response to the float signal to connect the inner spindle to the inner pipe section and to automatically command thrust of the carriage and dither rotation of the outer spindle to connect the outer spindle to the outer pipe section.

26. The system of claim 25 wherein the float sensor comprises centering springs.

27. The system of claim 25 wherein the inner spindle comprises a geometrical spindle pipe joint and the outer spindle comprises a threaded spindle pipe joint.

28. The system of claim 27 wherein the geometrical spindle pipe joint comprises a hex joint.

29. The system of claim 25 wherein the float sensor comprises an electromagnetic position sensor.

30. The system of claim 25 further comprising a pipe handling system adapted to load the pipe section into the carriage.

31. The system of claim 25 wherein the processor is further adapted to control the rotation of the outer spindle in response to the float signal.

32. The system of claim 25 wherein the float sensor further detects a carriage float position indicative of whether the inner pipe section is coupled to the inner pipe of the drill string, and to generate and transmit a second float signal to the processor, and wherein the processor receives the second float signal and automatically commands thrust of the carriage and rotation of the inner pipe section in alternating clockwise and counterclockwise directions in response to the second float signal to connect the inner pipe section to the inner pipe of the drill string.

33. The system of claim 25 wherein the inner spindle comprises a threaded spindle pipe joint.

* * * * *